US005879034A

United States Patent [19]

Johns

[11] Patent Number: 5,879,034

[45] Date of Patent: Mar. 9, 1999

[54] AUTOMATIC LOCKING DEVICE

[76] Inventor: Ernest W. Johns, 9455 NE. 38 Terr., Anthony, Fla. 32617

[21] Appl. No.: 953,490

[22] Filed: Oct. 17, 1997

[51] Int. Cl.[6] ..... E05C 3/06

[52] U.S. Cl. ..... 292/195; 291/1; 291/93; 291/DIG. 65

[58] Field of Search ..... 292/195, 210, 292/194, 230, 231, DIG. 65, 92, 93, 238, 1; 188/141; 244/81

[56] References Cited

U.S. PATENT DOCUMENTS

| | | | |
|---|---|---|---|
| 257,968 | 5/1882 | Mossman . | |
| 1,608,588 | 11/1926 | Dundek . | |
| 1,627,728 | 5/1927 | Conklin . | |
| 1,701,491 | 2/1929 | Casey . | |
| 2,193,077 | 3/1940 | Saxman . | |
| 4,091,758 | 5/1978 | Rosen | 114/144 C |
| 4,337,972 | 7/1982 | Gill | 292/67 |
| 4,671,023 | 6/1987 | Gigli | 52/1 |

*Primary Examiner*—Steven Meyers
*Assistant Examiner*—Gary Estremsky

[57] ABSTRACT

The doors of railroad passenger cars swing inward and toward the front of the car when opened for entry or exit by the passenger. An automatic locking device is described which may be mounted on the exterior surface of the door close to its trailing edge. When the railroad car is in motion, the pressure of the relative wind on an air foil acts to rotate the locking device to a position that prevents the door from opening. When the train slows and stops, the relative wind decreases and the locking mechanism returns to it's original position permitting the door to be opened.

8 Claims, 7 Drawing Sheets

AUTOMATIC LOCKING DEVICE

FIELD OF THE INVENTION

The present invention relates generally to an automatic latching device for securing the door of a railroad passenger car when the car is in motion and more specifically to latching means that does not have to be operated manually.

BACKGROUND OF TITLE INVENTION

Drastic changes in the transportation industry have occurred in the past forty years. Passengers that formerly depended on the railroad for long distance transportation are now traveling by air and the personal automobile is used by those who must make shorter trip. The railroad today moves freight that is not handled by trucks. Car trains, observation cars and other promotions encourage travelers who are not in a particular hurry to "relax and take the train", but thc method of securing the doors on railroad passenger cars has not changed during these many years.

The passenger train remains a series of passenger cars pulled over the tracks by the locomotive one behind the other. Each passenger car has seats so accommodate passengers on both sides of the car and a vestibule at the front and rear of the car. Entry and exit from the car is provided by a door that opens into the vestibule. The door or doors may he at either end and on either side of the car.

Railroad car doors are mounted on hinges to the front door jam in a manner that permits the rear edge of the door to swing inwardly and forward into the vestibule. This hinge mounting prevents the door of a passenger car from opening toward the outside of the train.

Over the years a number of passengers have been killed or injured due to leaving the car while the train is in motion. Apparently passengers were exiting the car doors thinking they were entering the bathroom. These tragedies generally end up it litigation against the railroad. While this problem could be solved by having the conductor locking all doors with a key before the train is in motion and unlocking the doors after the train is stopped, this procedure would be extremely time consuming because of the number of doors and the distance between doors, disrupting the schedule and increasing the time taken to reach the destination.

My invention solves; these problems by automatically latching the doors that exit a passenger car when the car reaches a speed of 10–15 miles per hour. When the train stops, the lock is released.

DESCRIPTION OF THE PRIOR ART

Over the years a substantial number of devices have been developed which will automatically fix a gate or door against movement from its closed position until some specific action is taken by the operator. U.S. Pat. No. 128,075 which issued to Sharp in 1872, describes a simple latch which is manually activated (by shutting the gate or door) and hold the gate or door in a closed position until manually released. It would not be desirable to install such a device on the door of a railroad passenger car because this latch could easily be activated by the passenger to open the door of the car while the train was in motion.

A later U.S. Pat. No. 2,683,049 issued in 1954 to Van der Spek describes a fastening device that may be shifted in a simple manner from its latching function to its locking function and vice versa, but at the same time, avoids any likelihood of the door being locked inadvertently. Again this device would permit the passenger to over ride the lock and open the door of the car while the train was in motion.

Most vehicle doors provided on automobiles and trucks, include vertically shiftable door latch lock activators shiftable between upper and lower inactive and active positions respectively. Lawrence J. Register, in his U.S. Pat. No. 3,990,531 describes an inertia activated locking mechanism having a weight that is responsive to sudden deceleration of a vehicle in a forward direction automatically shifting the conventional door latch lock activator to its active position in response to inertia forces.

U.S. Pat. No. 3,719,248 issued to Baeitschwerdt et al also describe a door lock for motor vehicles that will remain in the locked position if a vehicle accident occurs and U.S. Pat. No. 4,536,021 describes a locking system for the door of an automobile that will react to rapid deceleration by automatically and reliably unlocking the door in case of an emergency.

Thus there is a controversy between those who believe that the doors should remain closed following impact to prevent ejecting the occupants and those who believe that the doors should be easily opened from the outside following impact to facilitate removing from the automobile those passengers who may be unconscious.

BRIEF SUMMARY OF THE INVENTION

The present invention relates to an automatic latching device that may be installed on the door of a railroad passenger car. When the passenger car is not moving, a rigid bar assumes a position that is parallel with the edge of the door. When the passenger car is moving, this rigid bar rotates to a position extending beyond the edge of the door and effectively prevents the door from being opened.

Accordingly, one object of the invention is to provide a automatic latching device that may be installed on the door of a passenger car that will prevent that door from opening when the passenger car is in motion.

Another object of the present invention is to provide an automatic latching device which may be installed on the door of a passenger car that will unlock that door when the passenger car is not moving.

A further object of this invention is to provide an automatic latching device which may be easily and economically manufactured using readily available hardware.

Yet another object of the invention is to provide an automatic latching device that can be easily and quickly installed on the door of a railroad passenger car in fifteen minutes or less without the necessity of removing the passenger car from service.

Still another object of the invention is to improve the safety of passengers traveling on the National railroad system and to improve the safety record of those traveling by train.

An additional object of the invention is to provide an automatic latching device for the door of a railroad passenger car that cannot be unlocked when the car is in motion.

Yet another object of this invention is to provide an automatic latching device that will lock the door of a railroad passenger car when the train is moving forward or backward.

Another object of my invention is to provide an automatic latching device the parts of which are interchangeable for installation on the left side or the right side of railroad passenger cars.

It is also an object of the invention to provide an automatic latching device that is adaptable to the thickness of doors.

A final object of the invention is to provide an improved automatic latching device for the purpose described which is inexpensive, dependable and fully effective in accomplishing its intended purposes.

To the accomplishment of the foregoing and related ends, this invention then comprises the features hereinafter fully described and particularly pointed out in the claims, the following description setting forth in detail certain illustrative embodiments of the invention.

BRIEF DESCRIPTION OF THE DRAWINGS

The invention will be described with reference to the drawings in which corresponding numerals refer to the same parts and in which.

DETAILED DESCRIPTION OF THE PREFERRED EMBODIMENT

Figure 1:
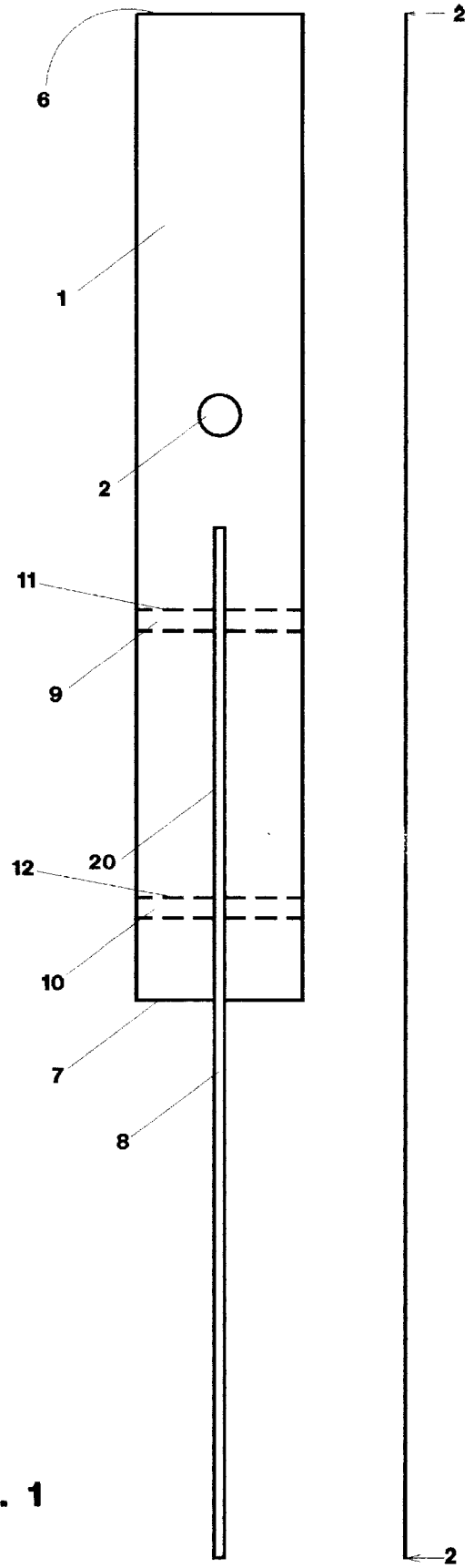
FIG. 1 is a plan view of an elongated bar that functions as the latching component of the present invention and illustrates an air foil fastened to thc bar.
Figure 2:
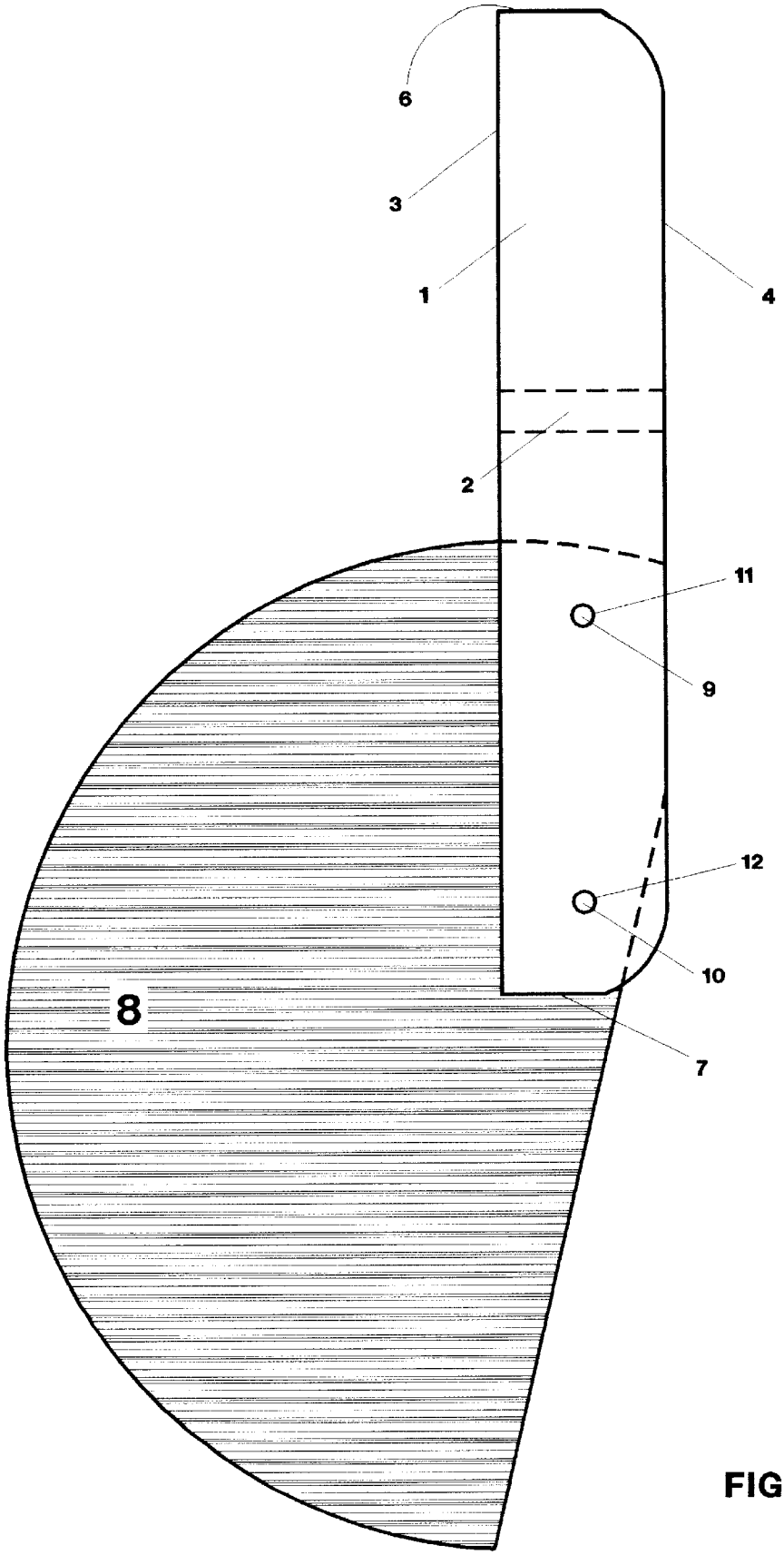
FIG. 2 is a side elevation of this latching component and air foil along line 2—2 of FIG. 1.
Figure 3:
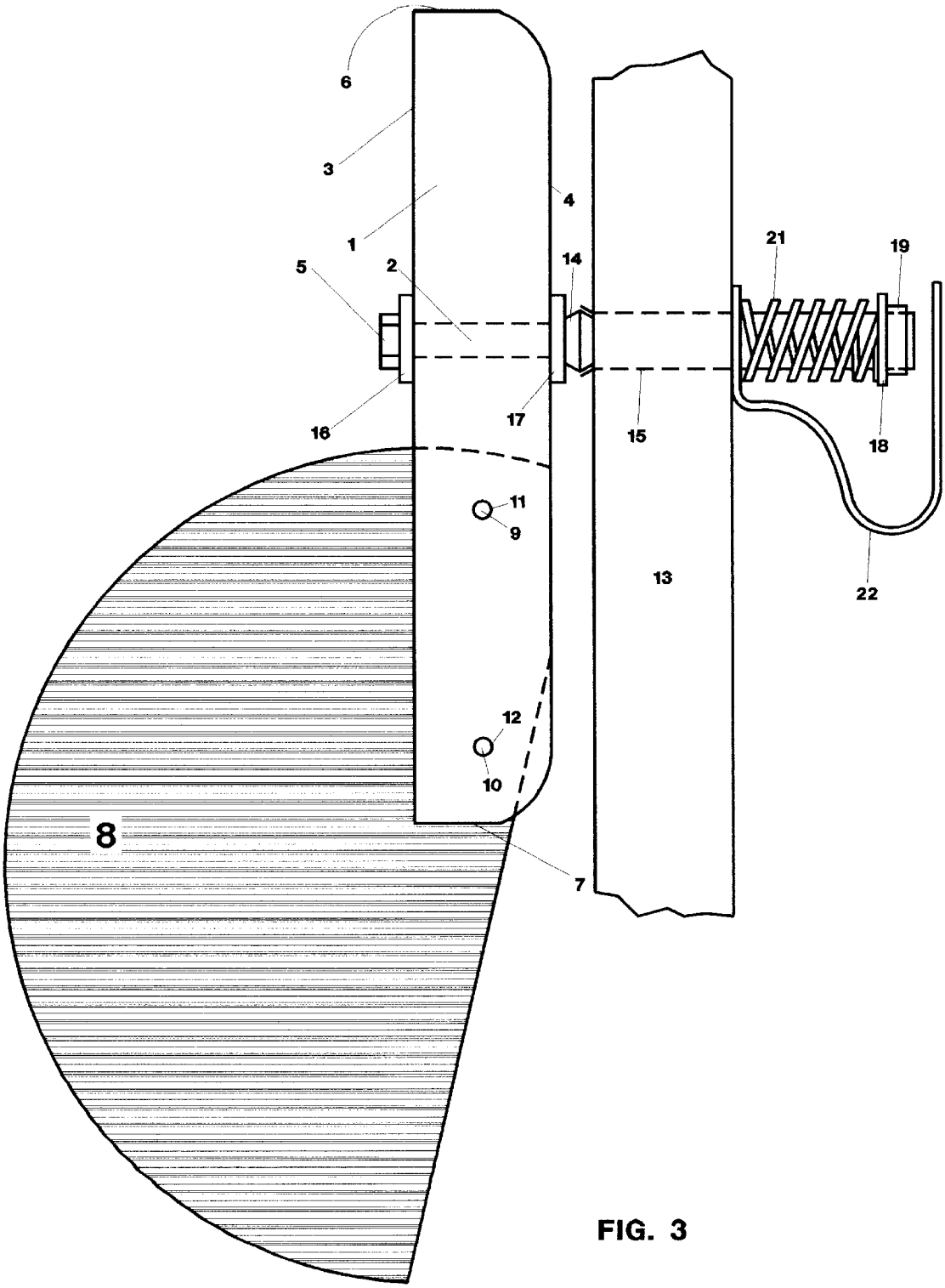
FIG. 3 is a side elevation of the automatic latching device of my invention installed on the door of a rail road passenger car.

Referring now to FIGS. 1, 2 and 3 of the drawings, the present invention will be seen to relate to an automatic latching device which may be installed on the door of a railroad passenger car. The lock comprises an elongated bar 1 the first end 6 and the second end at of which may be rounded to facilitate passage over a door jam. A hole 2 is drilled centered on the longitudinal axis of the bar perpendicular to the outer surface 3 and the inner surface 4 of the bar to receive a ¼th inch bolt 5. The hole 2 is riot centered between the ends of the bar but Ls drilled closer to the first end than to the second end.

The bar is bifurcated at 20 from the second end of the bar in the direction of the hole to receive an air foil 8. The air foil is fastened to the bar by means of two ⅛th inch roll pins 9 and 10 that are driven through the circular openings 11 and 12 which extend through the bar.

Referring now to FIG. 3, there is shown the automatic latching device of my invention installed on a door 13 of a railroad passenger car. The bar and air foil freely rotate on the bolt and a bearing 14 separates the bar from the outer surface of the door.

A tubular sleeve 15 extends through the door, and about ½ inch beyond the inside surface of the door, washers 16, 17 and 18 separate the various components of my lock and the nut 19 adjusts the tension against the bearing and regulates the freedom of rotation of the bar and air foil around the bolt. When the tension is properly adjusted, the bar and air foil will assume the position shown in FIG. 3 pointing toward the ground and parallel to the edge of the door when the railroad passenger car is not in motion.

Figure 4:
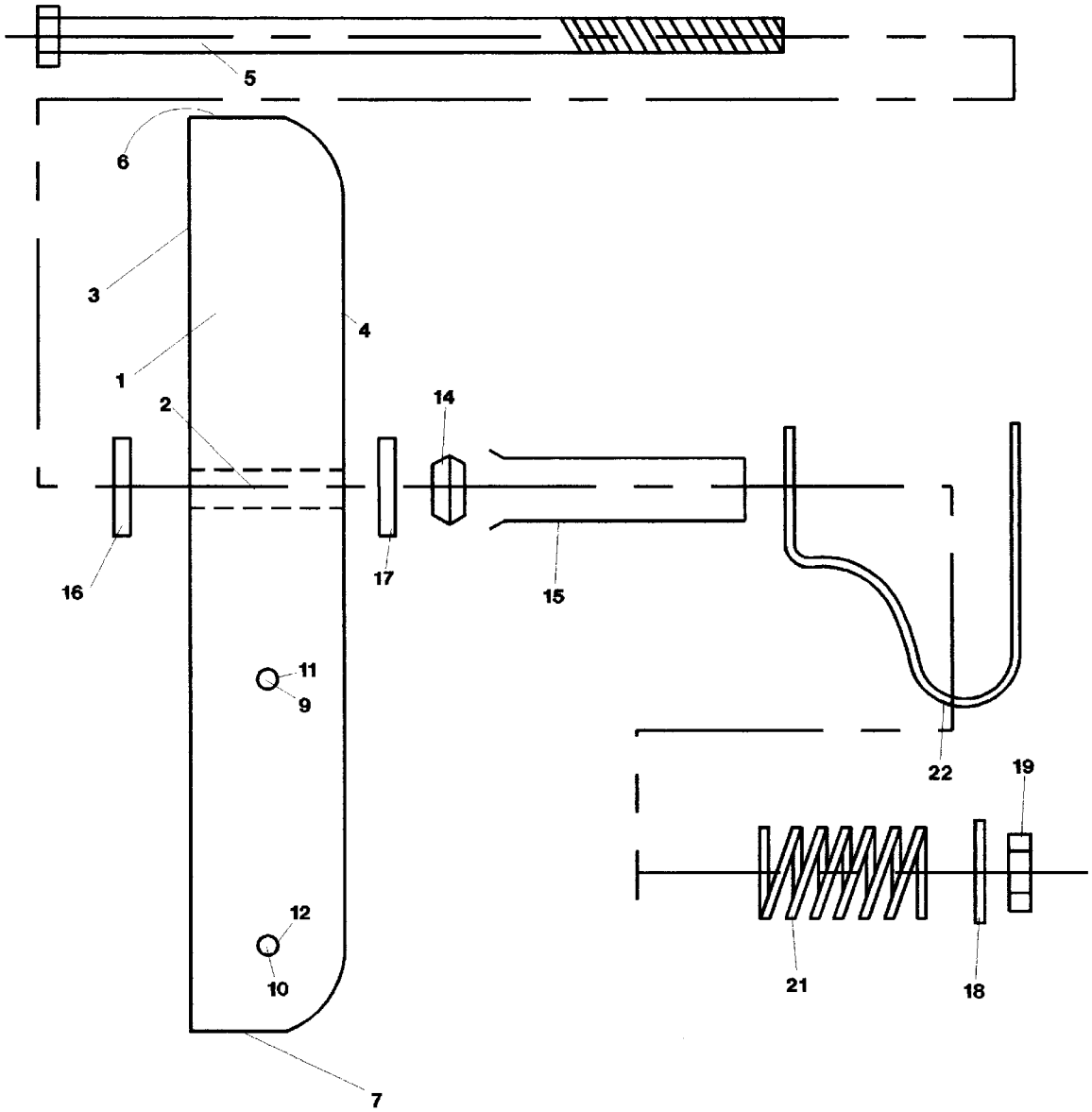
FIG. 4 is an exploded view of the automatic latching device of the present invention. The air foil is not present.

FIG. 4 illustrates various components of the automatic latching device of my invention. The spring 21 and the ice breaking strap 22 are not essential for the satisfactory operation of my automatic locking device. However, during the winter months rain, sleet and snow can freeze between the latching bar and the side of the railroad passenger cir preventing the lock from falling to it's unlocked position when the train stops. Under these conditions the latching bar may be released by striking that end of the bolt which extends through the door inside of the railroad passenger car. The spring, when present facilitates adjusting the tension holding the latching member against the bearing surface and the ice breaking strap, if present makes it more comfortable to exert pressure against the bolt or bolt and spring. The component parts of the automatic latching device of my invention are interchangeable in that the lock maybe installed on a door that is on the left side of a railroad passenger car or the right side of the railroad passenger car.

The bar is held in the position shown in FIG. 3 by the force of gravity. As all components of the automatic latching device of my invention, except the bar, are symmetrical around the bolt, the center of gravity would be at the axis of rotation if the hole in the bar were equidistant from both ends. However, the hole is not equidistant from both ends of the bar but is closer to the first end of the bar than to the second end of the bar. As the hole is shifted from the center of the bar toward the first end of the bar, the center of gravity of the bar will shift in the opposite direction. The bar is free to rotate about its axis and will shift to a position with its canter of gravity directly beneath the bolt as shown in FIG. 3.

The force holding the bar in the position illustrated in FIG. 3 is dependent upon three factors, namely the density of the material from which the bar is manufactured, the weight of the air foil and the location of the hole in the bar. The force maintaining the bar in the unlocked position will increase as the density of the bar and the weight of the air foil increases, but by far, the largest factor Contributing to this force is the location of the hole with respect to the first end of the bar.

Figure 6:
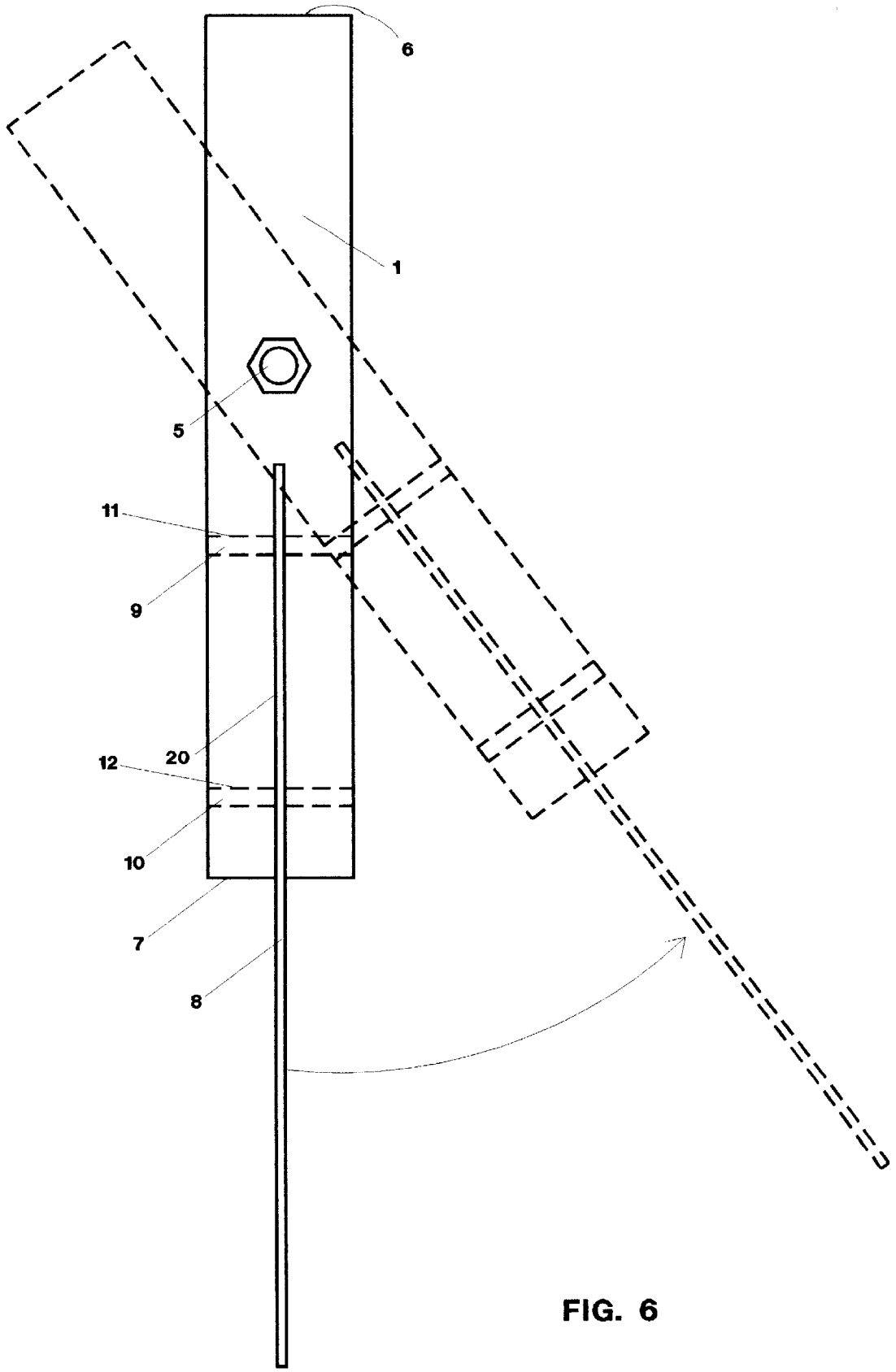
FIG. 6 is a plan view of the latching device of my invention and indicates the movement of the latching component upon movement of the railroad passenger car.

As best shown in FIG. 6, forward movement of the railroad passenger car through the air will generate a relative wind toward the rear of the passenger car thereby exerting a force against the air foil. As the velocity of the passenger car increases, so does the velocity of the wind and the force moving the bar into its locked position.

Referring now to FIG. 3 and FIG. 6, the automatic locking device of my invention illustrated in FIG. 3 will rotate as indicated by the arrow in FIG. 6 to the locking position shown by the dotted lines when the speed of the railroad passenger car reaches 10–15 miles per hour and will remain in the locked position until the railroad passenger car slows below 10 miles per hour.

Again, many different factors effect the movement of the bar from the unlocked position to the locked position as the railroad passenger car moves forward. Thus the tension holding the bar against the bearing surface, the density of the locking bar, the weight and location of the air foil, the temperature and density of the air and the different areas of the bar exposed to the wind on either side of the axis of rotation, will all have a slight effect on the rotation of the locking bar. The main factor however effecting movement of the locking bar into the locked position are the exposed area of the air foil, the location of the airfoil with respect to the axis of rotation and the distance from the axis of rotation to the first end of the locking bar and the second end of the locking bar. It follows that the speed at which the locking bar will shift between the locked and unlocked position may be changed by varying one or more of these factors.

I have found through the trial and error method of experimentation that the automatic locking device of my invention will rotate to the locked position when the railroad passenger car accelerates to 10–15 miles per hour and will rotate to the unlocked position when the speed decreases to about 10 miles per hour under the following conditions:

1. The locking bar is 6 inches in length and the hole is 2.44 inches from the first end (3.56 inches from the second end).

2. The air foil has an exposed area of 15.4 square inches. I have noted under these conditions (6 inch locking bar and 15.4 square inch air foil) that when the bolt around which the locking bar rotates is 1½ inches from the edge of the passenger car door the locking bar will move into the locking position at 10–15 miles per hour when the train is moving forward. When the train is moving backward under these same conditions (bolt holding the lock assembly of the present invention 1½ inches from the edge of the door) the locking bar will rotate in the opposite direction and lock the door when the train reaches a speed of 10–15 miles an hour.

It should be noted that the automatic latching device of my invention cannot he unlocked when the train is moving forward or backward at 10–15 miles per hour.

It must be recognized that I have described a specific automatic latching device and its method of operation. My invention is not limited to the specific dimensions of the preferred example but include other locking devices wherein a locking bar responsive to the force of gravity and the relative wind shifts between the unlocked and locked position.

Figure 5:
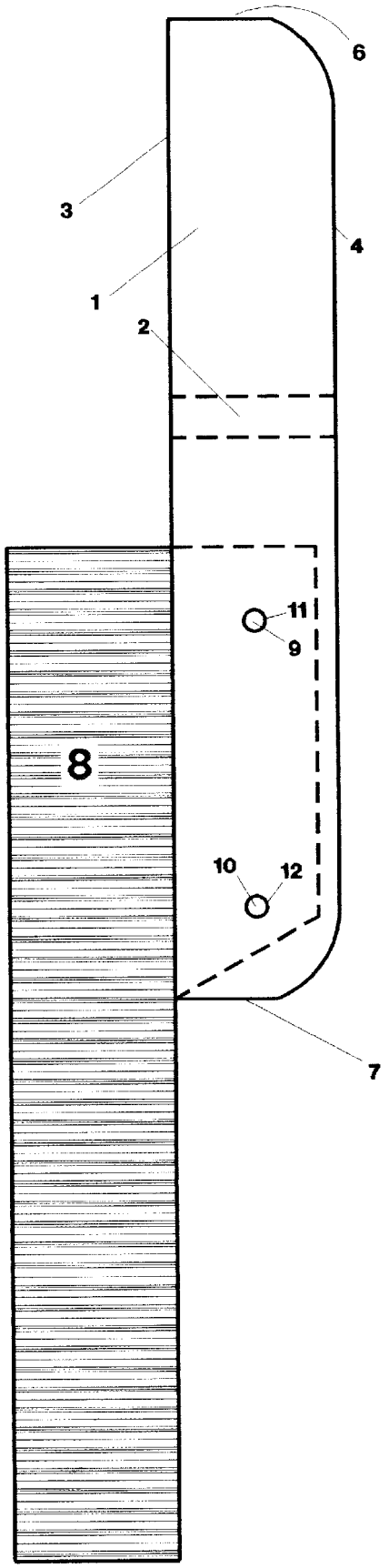
FIG. 5 is a side elevation of the automatic latching device of my invention and illustrates a smaller air foil fastened to the elongated bar.

As taught above, the air foil and the position of the hole in the locking bar are the primary factors effecting the operation of the automatic lock of th(e present invention. Thus, the locking bar may be 10 inches in length instead of 6 inches and the hole may be located 4.07 inches from the first end of the bar instead of 2.44 inches. The exposed area and location of the airfoil may be varied to obtain the desired speed at which the locking bar will shift between its unlocked and locked position. I have found that the locking bar illustrated in FIG. 5 the air foil of which has an exposed area of 6 square inches on a six inch locking bar will shift between the locking and unlocked position at 15–20 miles per hour. Such smaller air foil may be desirable to compensate for local winds through out the country.

As indicated above it is an advantage of the automatic locking device of my invention that many of it's components are readily available commercially at low cost. Thus a ¼ inch×4 inch steel bolt, ¼ inch flat washers, and a ¼ inch locking nut is available from the local hardware store. The 5/16 inch steel sleeve is readily available and may be flared if desired. The bearing is a standard item used in automobiles to provide an air Light fitting for air lines and is available from any local automobile parts store. The ice breaking strap may be cut and formed from sheet aluminum. I prefer to manufacture the locking bar from aluminum because aluminum is inexpensive, resists corrosion, has a low coefficient of friction and a density of 2.707.

I prefer to use 1/16th inch ABS plastic (acetate butadiene styrene) to form the air foil as it is easy to cut into the desired shape and is flexible (will not easily bend as sheet metal would). It is also an advantage Dt ABS plastic that it will not shatter at low temperatures.

Figure 7:
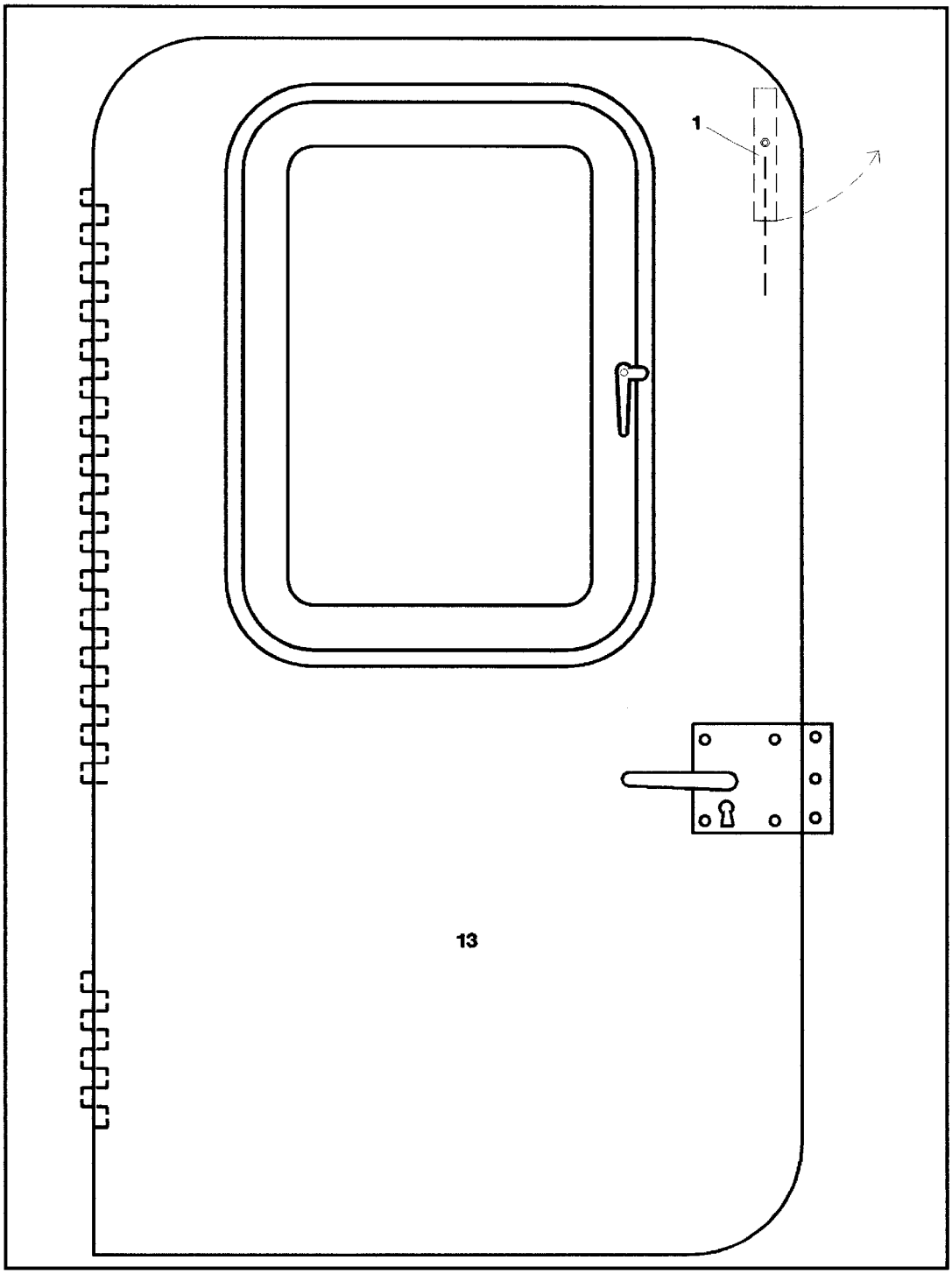
FIG. 7 is the door of a passenger car as viewed from inside the car.

The location of the automatic lock of my invention is best shown in FIG. 7. The locking bar is positioned on the outside surface of the door and sufficiently close to the trailing edge of the door that it will lock the door from the outside when the locking bar moves in the direction of the dotted arrow. The preferred position, as stated above, is 1 and ½ inches from the edge of the door. It will be rioted that the lock described may be adapted to the thickness of the door, if necessary by simply changing the length of the bolt. During inclement weather driving rain, snow and sleet may freeze on the lock when the train is in motion and prevent it from returning to the unlocked position when the train stops. The door may be easily unlocked under these conditions by simply pressing outward against the nut and bolt in opposition to the spring tension (if a spring is in place). This will break the locking bar lose from the side of the railroad passenger car and permit return to the unlocked position. Or the lock may be manually returned to it's unlocked position from inside the car if need be by opening the window to gain access to the lock.

It is apparent that many modifications and variations of this invention as hereinbefore set forth may be made without departing from the spirit and scope thereof. The specific embodiments described are given by way of example only and the invention is limited only by the terns of the appended claims.

What is claimed is:

1. An automatic locking device comprising:

(a) pivotal means having first and second ends for automatically preventing opening of an inwardly opening door, (b) an axle means for mounting substantially perpendicular to an outer surface of the inwardly opening door, said axle means supporting said latch means for rotation, (c) a bearing means mounted on said axle means said latch means, (d) an air foil means attached to said end of said latch means for causing automatic latching of the door when airflow in a direction substantially parallel to the outer surface of the door reaches a relative speed of about 10–15 miles per hour with respect to said air foil means, and wherein said latch means is automatically returned to an unlatched position by gravity when the airflow is less than about 10–15 miles per hour.

2. The locking device of claim 1 having a tubular sleeve to slip over said axle means adjacent said bearing means.

3. The locking device of claim 1 wherein said tubular sleeve is flared at one end to form an annular flange, said tube being positioned on said axle means with the annular flange adjacent said bearing means.

4. The locking device of claim 1 wherein said bearing means is a ferrule.

5. the locking device of claim 1 having a spring surrounding said axle means.

6. The locking device of claim 1 having a flexible U shaped member movably mounted on said axle means.

7. The locking device of claim 1 wherein said bearing means is a ferrule, said locking device having a tubular sleeve flared at on end to form an annular flange and sized to slip over said axle means with the annular flange adjacent said bearing means, a spring surrounding said axle means and a flexible U shaped member movably mounted or said axle means.

8. The locking device of claim 1 wherein said axle means is a bolt.

* * * * *